United States Patent [19]

Fiordellisi et al.

[11] Patent Number: 4,478,441

[45] Date of Patent: Oct. 23, 1984

[54] VEHICLE BODY CLOSURE LATCH

[75] Inventors: Stephen J. Fiordellisi, Warren; Bela Gergoe, Birmingham; John W. Hamilton, Dearborn, all of Mich.

[73] Assignee: General Motors Corporation, Detroit, Mich.

[21] Appl. No.: 424,467

[22] Filed: Sep. 27, 1982

[51] Int. Cl.[3] ..... E05C 3/26; E05C 13/04

[52] U.S. Cl. ..... 292/216; 292/336.3; 292/DIG. 25

[58] Field of Search ..... 292/28, 38, 50, 225, 292/336.3, 125, 133, 141, 171, DIG. 25, 216

[56] References Cited

U.S. PATENT DOCUMENTS 2,393,647 1/1946 Marple ..... 292/DIG. 14 X 3,893,207 7/1975 Rudaitis et al. ..... 292/DIG. 14 X 4,266,816 5/1981 Mubai et al. ..... 292/225 X 4,331,353 5/1982 Yazawa et al. ..... 292/28

*Primary Examiner*—Richard E. Moore

*Attorney, Agent, or Firm*—Herbert Furman

[57] ABSTRACT

A release arrangement for releasing the detent of a latch for an exterior vehicle body closure from the inside of the body. The release arrangement includes a manually operable pivotal handle connected by a cable to an auxiliary release lever for the detent and a pull handle also connected to the release lever by another cable. The pivotal handle is mounted to a support within the body and the pull handle is releasably stored on the support. Separate housings of a common sheath house the cables.

3 Claims, 12 Drawing Figures

VEHICLE BODY CLOSURE LATCH

This invention relates generally to vehicle body closure latches and more particularly to a release arrangement for releasing a vehicle body closure latch.

The release arrangement of this invention is particularly intended for releasing the latch of an exterior vehicle body closure, such as a hood or deck lid, from the inside of the body. Generally such latches include a detent and a bolt respectively biased to detented and unlatched positions.

Generally the release arrangement includes a manually operable pivotal handle which is connected by a cable to an auxiliary latch release lever for the vehicle body closure latch. The auxiliary release lever is mounted in a separate housing and includes an abutment engageable with an abutment of the detent to move the detent to released position when the cable is shifted by the handle. In order to provide for an additional release, a second cable extends between the auxiliary release member and a manually operable pull handle. Either handle may be used to release the detent of the closure latch from the inside of the body. The cables are housed in separate housings of a common sheath extending between the support of the pivotal handle and the housing of the auxiliary release lever. The pull handle is stored on this support.

One feature of this invention is that it provides a vehicle body closure latch release arrangement which includes a pair of manual operators located inside the body and individually cable connected with an auxiliary release member for individually actuating the release member to move the detent of the closure latch to released position with respect to the latch bolt. Another feature is that the cables are individually housed in a common sheath and are individually shiftable to actuate the release member upon manual operation of their respective operator. A further feature is that one operator is a pivotal handle and the other is a pull handle. Yet another feature is that the pull handle is releasably stored on the support of the pivotal handle. Yet a further feature is that the auxiliary release member is mounted in a housing separate from the closure latch housing and includes an abutment projecting into the latter housing and engageable with the detent of the latch.

These and other features of the invention will be readily apparent from the following specification and drawings wherein.

Figure 1:
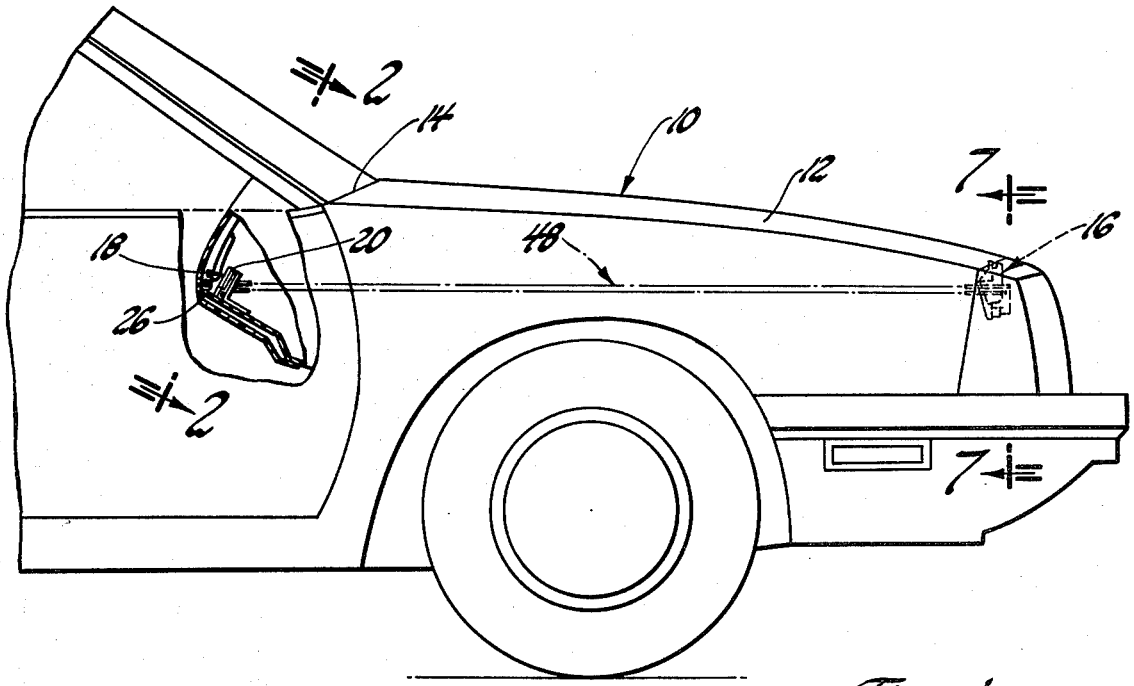
FIG. 1 is a partially broken away partial side view of a vehicle body embodying a release arrangement according to this invention.
Figure 5:
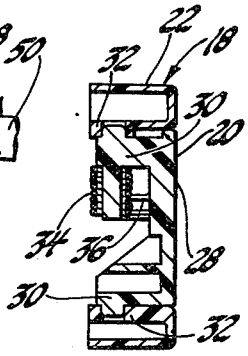
FIG. 5 is a sectional view taken along line 5—5 of FIG. 4.

Referring now particularly to FIG. 1 of the drawings, a vehicle body designated generally 10 includes a hood 12 which is hinged adjacent its rearward end 14 to body 10 for movement between a closed position as shown and an open position, not shown, with respect to the front compartment of the body. The hood 12 is held in its closed position by a conventional vehicle body closure latch 16 of the type including a fork type latch bolt and a detent. The detent of the latch 16 is moved to released position with respect to the bolt by a release arrangement 18 according to this invention. The release arrangement 18 includes an inside manual operator 20, FIGS. 2 through 6, which includes a molded plastic support or housing 22 having a number of integral bosses 24 which receive fasteners, not shown, for mounting the housing 22 in a convenient location on the vehicle such as either to the front wall or lower wall of the instrument panel 26 for actuation by the driver. The operator 20 further includes a paddle type handle 28 which as shown in FIG. 5, includes a pair of integral inwardly extending legs 30 having ears fitted within apertured walls 32 of housing 22 to pivotally mount the handle 28 to the housing. A coil torsion spring 34 surrounds an integral extension of one of the legs 30 and has one end thereof engaging a slotted inwardly extending leg 36, FIG. 4, of handle 28 and the other end thereof engaging a slotted integral tab 38, FIGS. 2 and 4, of the housing 22 to bias the handle to closed position against a bumper 40 of a recessed wall 42 of the housing. Wall 42 partially covers an opening through the housing defined by inwardly extending wall 44.

Figure 2:
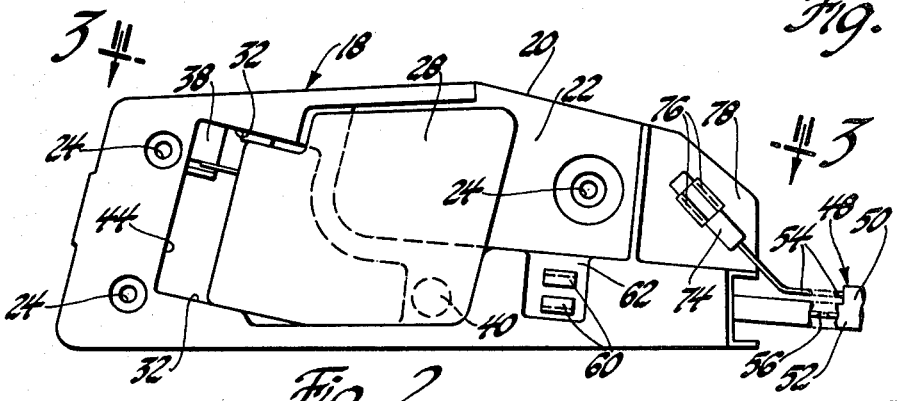
FIG. 2 is an enlarged view taken generally along line 2—2 of FIG. 1.
Figure 6:
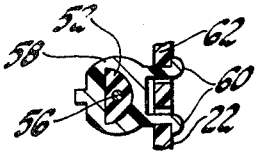
FIG. 6 is a sectional view taken generally along line 6—6 of FIG. 3.
Figure 4:
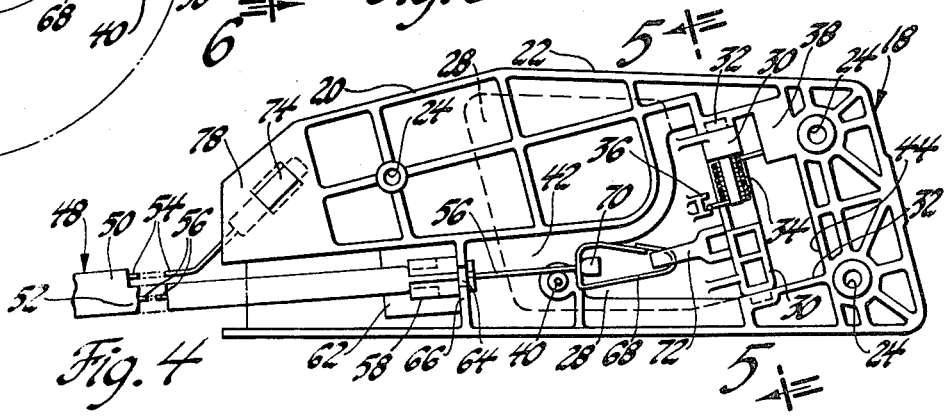
FIG. 4 is a view taken along line 4—4 of FIG. 3.

A cable assembly 48 includes a molded plastic sheath having integral semi-cylindrical cross-section cable receiving housings 50 and 52, which respectively slidably receive push pull cable members 54 and 56. As shown in FIGS. 4 and 6, the inner end of member 52 terminates within an end fitting 58 which includes a pair of hooked shaped legs 60 hooked within slots in a recessed wall 62 of the housing 22 to secure the sheath to the housing. The fitting 58 further includes a grooved neck 64 which is received within a slotted web 66 of the housing 22 to additionally secure the sheath to the housing 22. The housing 50 terminates short of the housing 22 as shown in FIGS. 2 and 4 and is supported with respect to the housing 22 by the housing 52. The inner end of the cable 56 is received through an apertured leg of a clevis 68 and rotatably secured thereto by a ball 70 fixed to the cable. The clevis which is hooked through an integral ear 72 of handle 28 to connect the inner end of the cable 56 to the handle. The inner end of the cable 54 is fixed to a handle 74 which is releasably secured to housing 22 or stored by a pair of resilient legs 76 formed integrally with the housing 22 and extending outwardly of a recessed wall 78 thereof.

Figure 7:
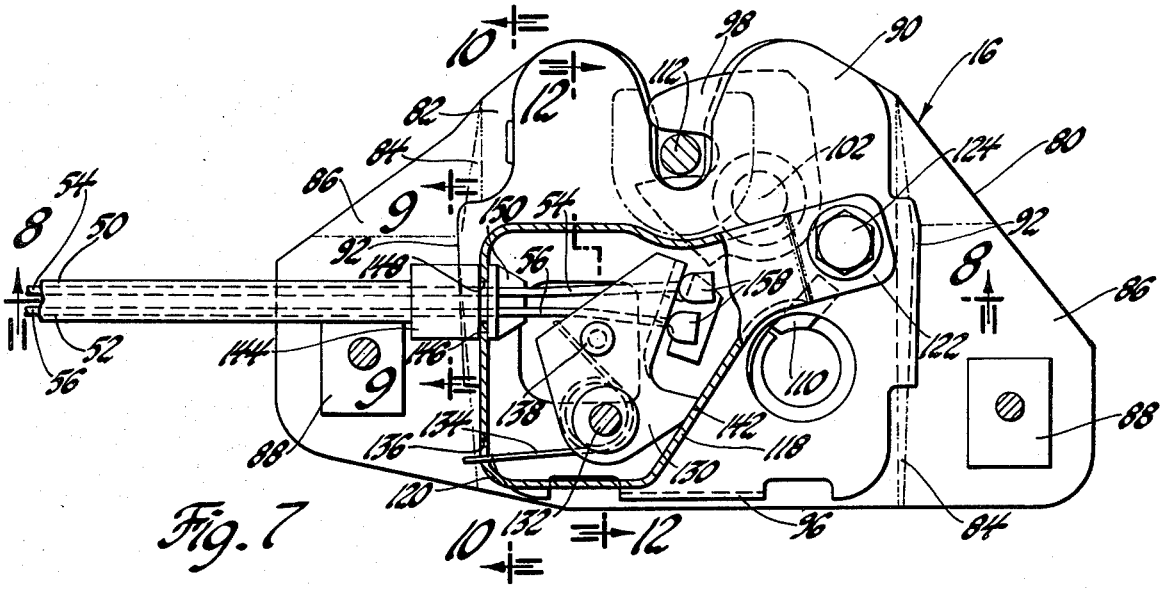
FIG. 7 is an enlarged view taken along line 7—7 of FIG. 1.
Figure 8:
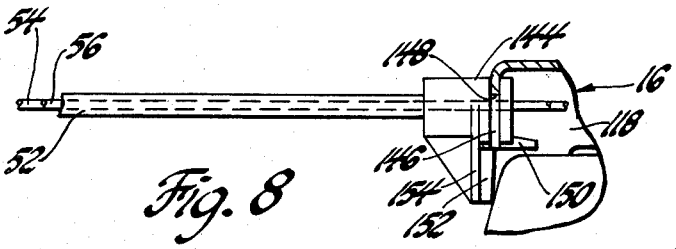
FIG. 8 is a view taken along line 8—8 of FIG. 7.
Figure 9:
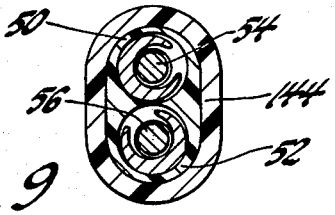
FIG. 9 is an enlarged sectional view taken along line 9—9 of FIG. 7.
Figure 11:
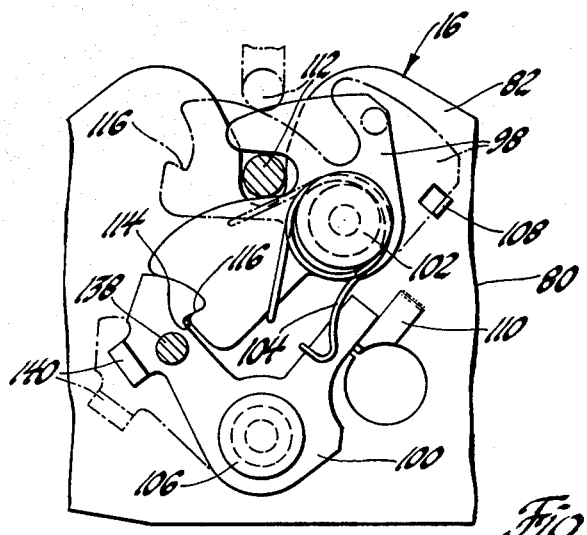
FIG. 11 is a partially broken away view taken of a portion of FIG. 7.

As shown in FIGS. 7 and 11, the latch 16 includes a frame 80 having an inner base wall 82, a pair of laterally extending side walls 84 and a pair of flanges 86 which extend laterally of the side walls and mount weld nuts or pierce nuts 88 for mounting the frame 80 to the front wall of the hood compartment of the vehicle. A cover or outer wall 90 includes lateral flanges 92 welded to the walls 84 and lateral flange 96 secured to the wall 82 to space wall 90 outwardly of the wall 82. A conventional fork type latch bolt 98 and detent 100 are located between walls 82 and 90. The bolt 98 is pivotally mounted on a headed pin 102 secured to wall 82. The bolt is biased clockwise to its released position shown in full lines by a coil torsion spring 104 which surrounds the pin 102 and has one leg hooked to the bolt 98 and the other leg to the detent 100. The detent 100 is freely pivoted on a headed pin 106 secured to the wall 82. The spring 104 engages the bolt 98 with a lanced tab 108 of wall 82 and the detent 100 with a lanced tab 110 of wall 82 to respectively locate the bolt in unlatched position and locate the detent in detented position as shown in FIG. 11. The bolt 98 is moved to its latched position shown in dash lines in FIG. 11 against the bias of spring 104 by the engagement thereof with a conventional U-shaped striker 112 mounted on the hood 12. When the bolt is in latched position, it is retained against the bias of the spring by the engagement of the shoulder 114 of the detent with a shoulder 116 of the bolt. The latch 16 is in current production use and therefore only a brief description has been given.

Figure 10:
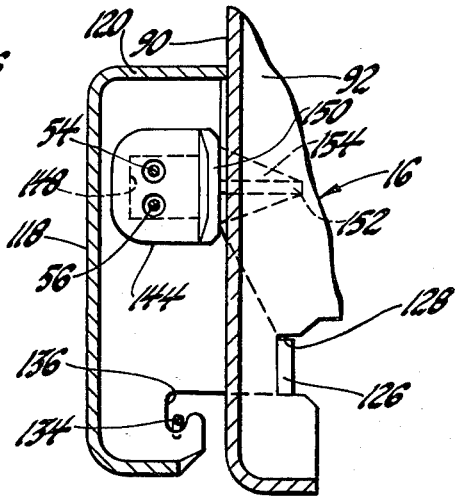
FIG. 10 is an enlarged view taken along line 10—10 of FIG. 7.

An auxiliary flanged housing 118 overlies the wall 90. The housing 118 includes a peripheral flange 120 which spaces the housing with respect to the wall 90 and is retained thereto by an offset foot 122 bolted at 124 to wall 90 and a lateral tab 126 hooked within a slot 128 of a flange 92 of the wall 90, FIG. 10. An auxiliary release lever 130 is pivoted by a shouldered stud 132 to the housing 118. A coil torsion spring 134 surrounds the stud 132 and has one leg hooked within a slot 136, FIG. 10, in flange 120 and the other leg engaging a pin or abutment 138 which is fixed to the lever 130 and extends in the rotative path of lateral flange or abutment 140 of detent 100 as shown in FIG. 11. Lever 130 is located against the bias of spring 134 by a foot 142 thereof, FIG. 7, engaging flange 120.

Figure 12:
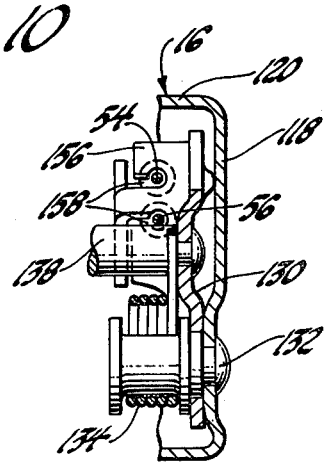
FIG. 12 is a sectional view taken along line 12—12 of FIG. 7.

As shown in FIGS. 7 through 10, the outer ends of the sheath housings 50 and 52 are secured to a fitting 144. The fitting has a slot 146 receiving the side edge portions of an opening 148 in flange 120 of cover 118 to secure the fitting to the cover. Flanges 150 and 152 of the fitting respectively bear against wall 90 and flange 92 to prevent tipping of the fitting relative to cover 118. Flange 152 is reinforced by flange 154. The cables 54 and 56 extend outwardly of the fitting 144 and through respective slots of a flange 156 of lever 130, FIG. 12. A ball 158 is fixed to the end of each cable and is engageable with flange 156 of lever 130 to individually actuate the release lever.

Figure 3:
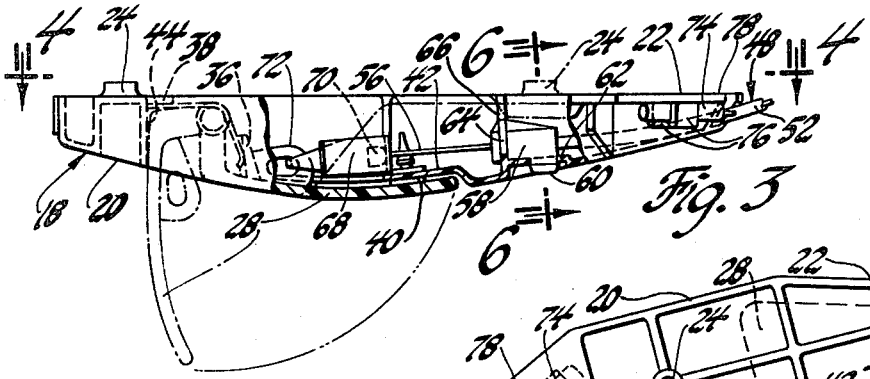
FIG. 3 is a partially broken away view taken generally along line 3—3 of FIG. 2.

Should the driver desire to release the closure latch 16 from inside the body in order to move the hood 12 to an open position, the handle 28 is pivoted outwardly of the housing 22 to its operative position shown in dash lines in FIG. 3 to pull or shift the cable 56 rearwardly of the body within housing 52. The engagement of the ball 158 on the outer end of this cable with flange 156 of lever 130 swings the lever counterclockwise as viewed in FIGS. 7 and 11 to engage the abutment 138 of the lever with abutment 140 of the detent 100 and move the detent to released position shown in dash lines in FIG. 11. Spring 104 thereupon moves the latch 98 to its released position shown in full lines in FIG. 11 to release striker 112 and permit the hood 12 to be opened.

The latch 16 can also be released by the driver by removing handle 74 from within the legs 76 of housing 22 and pulling on the handle to shift cable 54 rearwardly within housing 50 and rotate lever 130 in the same manner as previously described.

During the movement of the lever 130 by one cable, the other cable remains stationary since the flange 156 merely slides relative to such other cable.

Thus this invention provides an improved release arrangement for a vehicle body closure latch.

The embodiments of the invention in which an exclusive property or privilege is claimed are defined as follows:

1. In a vehicle body, a closure latch having a latch bolt and a detent movable to released position with respect to the latch bolt, a remote release arrangement for moving the detent to the released position, comprising, in combination, an auxiliary release lever movably mounted on the closure latch and including an abutment engageable with the detent to move the detent to released position, first and second individually actuated manual operators mounted on the vehicle, first and second cables respectively extending from the first and second operators to the release lever, each cable slidably extending through the release lever and including an abutment thereon engageable with the release lever upon actuation of its respective operator to move the release lever relative to the other cable and engage the release lever abutment with the detent to move the detent to released position, and a cable housing extending between each operator and the release lever for housing a respective cable.

2. In a vehicle body, a closure latch having a latch bolt and a detent movable to released position with respect to the latch bolt, a remote release arrangement for moving the detent to the released position, comprising, in combination, an auxiliary release lever movably mounted on the closure latch and including an abutment engageable with the detent to move the detent to released position, a support mounted on the vehicle, a manually operated first handle pivotally mounted on the support, a pull type second handle releasably mounted on the support and detachable therefrom for actuation, first and second cables respectively extending from the first and second handles to the release lever, each cable slidably extending through the release lever and including an abutment thereon engageable with the release lever upon actuation of its respective handle to move the release lever relative to the other cable and engage the release lever abutment with the detent to move the detent to released position, and a cable housing extending between each handle and the release lever for housing a respective cable.

3. In a vehicle body, a closure latch having a latch bolt and a detent movable to released position with respect to the latch bolt, a remote release arrangement for moving the detent to the released position, comprising, in combination, an auxiliary housing mounted on the closure latch, an auxiliary release lever mounted within the housing and including a multiple apertured flange and an abutment, resilient means coupled between the housing and the release lever and locating the release lever in engagement with the housing to locate the abutment thereof in the path of the detent for engagement therewith to move the detent to released position, first and second individually actuated manual operators mounted on the vehicle, first and second cables respectively extending from the first and second operators through an aperture of the release lever flange and including an abutment thereon engageable with the release lever flange upon actuation of its respective operator to move the release lever relation to the other cable and engage the release lever abutment with the detent to move the detent to released position, and a cable housing extending between each operator and the release lever for housing a respective cable.

* * * * *